US009936824B2

(12) United States Patent
Resch

(10) Patent No.: US 9,936,824 B2
(45) Date of Patent: Apr. 10, 2018

(54) CONTAINER COOLING SHELF

(71) Applicant: AHT Cooling Systems GmbH, Rottenmann (AT)

(72) Inventor: Reinhold Resch, St. Peter (AT)

(73) Assignee: AHT Cooling Systems GmbH (AT)

( * ) Notice: Subject to any disclaimer, the term of this patent is extended or adjusted under 35 U.S.C. 154(b) by 10 days.

(21) Appl. No.: 15/117,912

(22) PCT Filed: Feb. 4, 2015

(86) PCT No.: PCT/EP2015/052291

§ 371 (c)(1),
(2) Date: Aug. 10, 2016

(87) PCT Pub. No.: WO2015/118004

PCT Pub. Date: Aug. 13, 2015

(65) Prior Publication Data

US 2016/0353905 A1 Dec. 8, 2016

(30) Foreign Application Priority Data

Feb. 10, 2014 (DE) ..... 20 2014 100 562 U

(51) Int. Cl.
*F25D 15/00* (2006.01)
*A47F 3/04* (2006.01)

(52) U.S. Cl.
CPC ..... *A47F 3/0491* (2013.01); *A47F 3/04* (2013.01); *A47F 3/0447* (2013.01); *A47F 3/0469* (2013.01); *F25D 15/00* (2013.01); *A47F 2003/046* (2013.01)

(58) Field of Classification Search
CPC ..... A45F 3/0447; A37F 3/0443
USPC ..... 62/256
See application file for complete search history.

(56) References Cited

U.S. PATENT DOCUMENTS

2005/0257548 A1 11/2005 Grassmuck

FOREIGN PATENT DOCUMENTS

| | | |
|---|---|---|
| DE | 102010036929 | 2/2012 |
| JP | S49141093 | 12/1974 |
| JP | H07113570 | 5/1995 |

*Primary Examiner* — Melvin Jones
(74) *Attorney, Agent, or Firm* — Jansson Munger McKinley & Kirby Ltd.

(57) ABSTRACT

The invention is a container refrigeration case having at least one cooling air duct extending through a wide area of a rear wall unit and top unit, having a bottom region that accommodates a rolling container, and having side wall units. Cooling air is guided to circulate through the cooling air duct, a cooling air curtain traveling from top to bottom on the front side, and across the bottom region. The bottom region has a flat bottom structure situated under the container, an inner cover oriented toward the cooling chamber, and a floor-side duct section embodied under the inner cover which routes the cooling air duct from the front side to the lower, rear section of the cooling air duct.

7 Claims, 6 Drawing Sheets

CONTAINER COOLING SHELF

CROSS-REFERENCE TO RELATED APPLICATION

The present application is a U.S. national phase entry of pending International Patent Application No. PCT/EP2015/052291, international filing date Feb. 4, 2015, which claims priority to German Patent Application No. DE 20 2014 100 562.5, filed Feb. 10, 2014, the contents of which are incorporated by reference in their entireties.

FIELD OF THE INVENTION

The device relates to a container refrigeration case having at least one cooling air duct extending through a wide area of a rear wall unit and top unit, having a bottom region that accommodates a rolling container, and having side wall units, wherein cooling air is guided to circulate through the cooling air duct, through a cooling air curtain traveling from top to bottom on the front side, and via the bottom region.

BACKGROUND OF THE INVENTION

A container refrigeration case of this kind is disclosed in DE 32 10 423 A1. In this known container refrigeration case, a front panel is secured to lateral support arms and by means of these arms and laterally positioned hinge bearings in the vicinity of the rear wall, can be pivoted upward in order to permit a rolling container to travel in on the installation floor. In the operating state, the front panel is pivoted downward by means of the support arms and a front cooling air curtain guided in front of the inserted rolling container and under it, passing through into a cooling air conduit on the rear wall side, and in the middle and upper region, is deflected so that it circulates forward again into the front cooling air curtain.

A similar design of a container refrigeration case is also disclosed in DE 200 00 012 U1, an embodiment variant being provided with lateral hinge bearings situated in the front region for the support arms of the front panel. Another such refrigeration case is also disclosed in EP 0 158 297 B1.

EP 0 441 357 B1 discloses a refrigeration case, but not a refrigeration case for a rolling container, in which a lower, front panel can be pivoted downward to make it easier to stock with products. In container refrigeration cases, one disadvantage lies in the fact that the cooling air flow is disadvantageously influenced by the container that has been inserted into the unit.

OBJECTS OF THE INVENTION

An object underlying present invention is to create a container refrigeration case that makes it possible to achieve a more effective use of the cooling capacity with a user-friendly design. This object is attained with the features of claim 1. In this instance, in order to guide the cooling air, the bottom region is provided with a flat bottom structure situated under the container when the latter is inserted, having an inner cover oriented toward the cooling chamber and a floor-side duct section embodied under this inner cover, which routes the cooling air duct from the front side to the lower, rear section of the cooling air duct.

SUMMARY OF THE INVENTION

In accordance with the present device, a refrigerated device is presented. With the claimed measures, the rolling container can be moved into and out of the refrigeration case in an easy-to-control way, while the cooling air is conveyed from the cooling air curtain provided on the front side into the duct section at the bottom, and through the latter, is introduced into the rear cooling air duct from below. Advantageously in this case, the rear region of the bottom duct section is tightly connected to the lower rear region of the cooling air duct.

For the design and function, it is advantageous that the inside cover is supported in the direction of the installation floor by means of support struts extending from the front to the back in the depth direction. A plurality of support struts extending from front to back, i.e. in the depth direction, thus produce a stable support for the inner cover oriented toward the installation floor, even for relatively heavily loaded containers. In this instance, the bottom structure advantageously extends across the entire width of the case between the side wall units. Alternatively, the bottom structure with the support struts can also be embodied so that in the vicinity of the wheels of the rolling container, it leaves the installation floor uncovered so that the rolling container in the case rests on the floor and the bottom structure is situated with the bottom duct section between the wheels. In this instance, however, it is necessary to make an adjustment between the width of the rolling container and the width of the bottom structure, it being possible for the width to vary.

For the design and function, it is also advantageous if the inner cover extends across the entire width of the case between two side wall units and, in the front edge region of the inner cover, a ramp for a rolling container is attached to it, sloping diagonally down to the installation floor toward the front. It has turned out to be advantageous to provide an inclination angle of the ramp relative to the horizontal in a range of between 10° and 25°, for example between 14° and 18°.

A good function with advantageous air conduction is achieved by the fact that the ramp and/or a front region of the inner cover adjacent to it is/are provided with an air passage grille.

If the rear region of the inner cover is spaced less far apart from the installation floor than its front region and slopes down slightly from front to back, then this achieves a secure footing of the rolling container in the case. For example, with conventional case depths, a sufficient slope toward the rear is achieved if the front region of the inner cover is approximately 0.5 cm to 2 cm higher above the installation floor than its rear region.

Other advantages for the design and function are achieved in that in the operating state, a bottom front panel is provided along and in front of the front side of the bottom structure, which bottom front panel is secured to lateral support arms and by means of these arms, can be pivoted upward in order to permit a rolling container to travel in and out.

For an effective use of the cooling air, it is also advantageous if an air conduction through the front panel is provided in order to convey the front cooling air curtain into the bottom duct section.

Contributions to an advantageous design with a high degree of stability and good air conduction are made by the fact that the support struts are embodied in the form of right-angle bends in the plate-shaped support sections, which are attached to the underside of the inner cover, e.g. by means of rivets, screws, welding, or gluing.

Contributions to a good stability are also made by the fact that along their lower edge, the support struts are provided with support flanges that are bent at right angles.

An advantageous embodiment with a definite air conduction in the floor section oriented toward the floor is also achieved in that on its side oriented toward the installation floor, the bottom structure has an outer cover, which is made of thermally insulating material, e.g. foamed plastic, or of a non-thermally insulating material, e.g. a simple piece of sheet metal. The thermally insulating design contributes to energy optimization, for example in a floor heating of the installation space.

BRIEF DESCRIPTION OF THE DRAWINGS

The drawings illustrate a preferred embodiment including the above-noted characteristics and features of the device. The device will be readily understood from the descriptions and drawings. In the drawings.

DETAILED DESCRIPTION OF PREFERRED EMBODIMENTS

Figure 1:
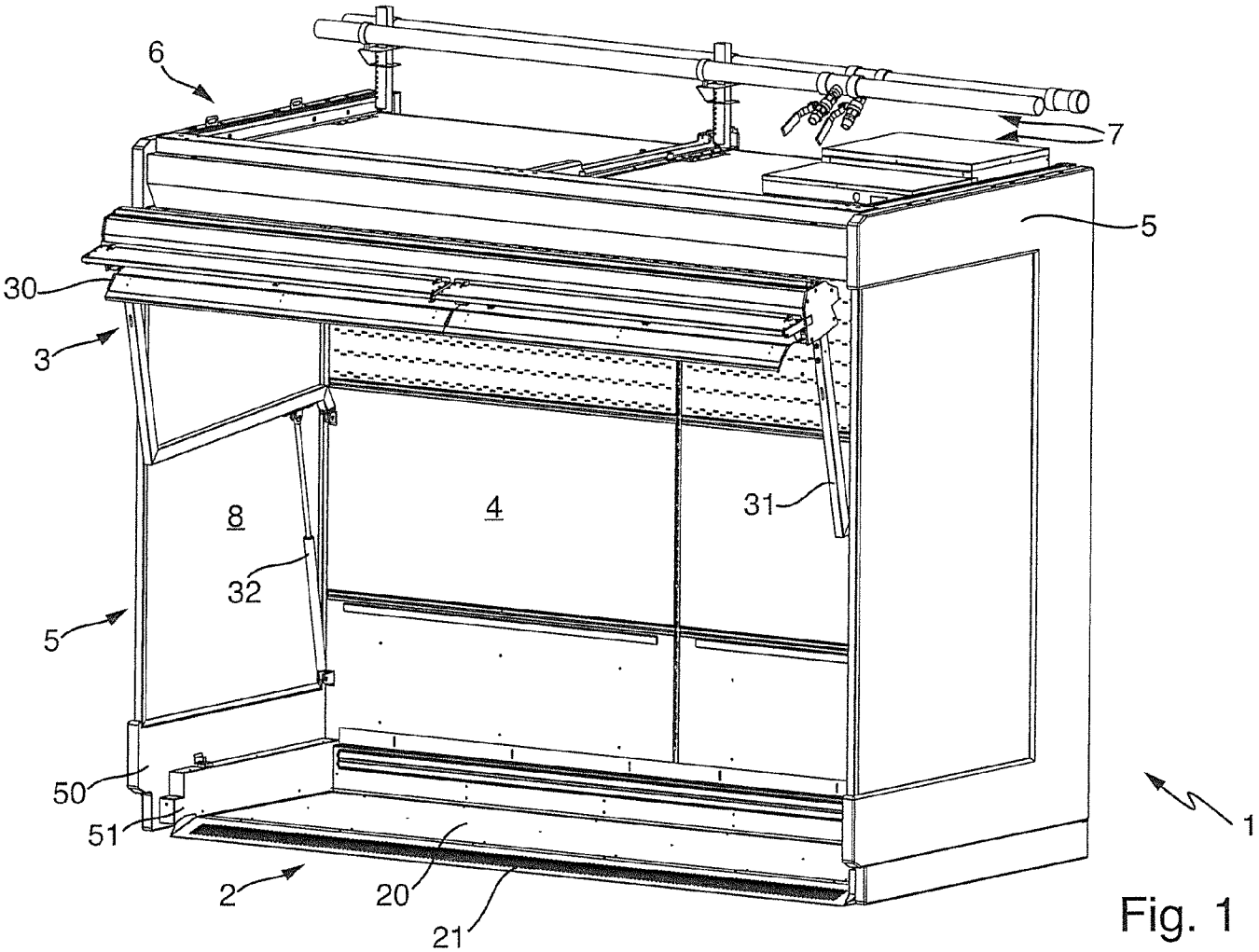
FIG. 1 is a side perspective view from the side of a container refrigeration case with the front panel pivoted upward.

FIGS. 1-6B illustrate a container refrigeration case 1. Case 1 is shown obliquely from the front in FIG. 1 and includes a bottom region with a bottom structure 2, a rear wall unit 4, two side wall units 5, and a top unit 6, on which components of a cooling unit 7 are situated. The front side 8 of container refrigeration case 1 is open. In addition, container refrigeration case 1 is provided with a pivoting front panel arrangement 3 that is pivoted upward in FIG. 1.

Figure 2:
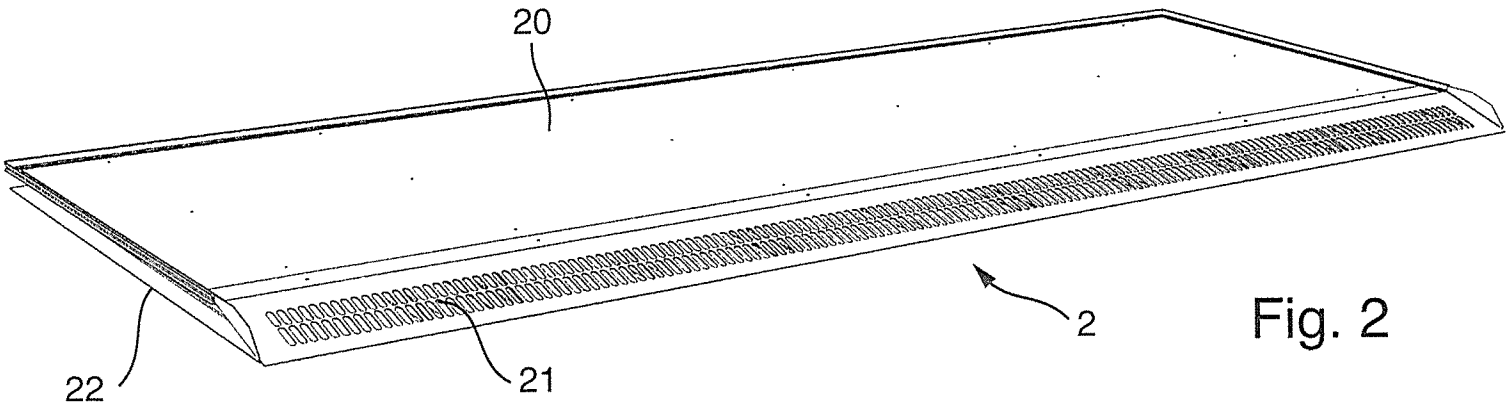
FIG. 2 is a top perspective view from above and in front of a bottom structure of the container refrigeration case.
Figure 3:
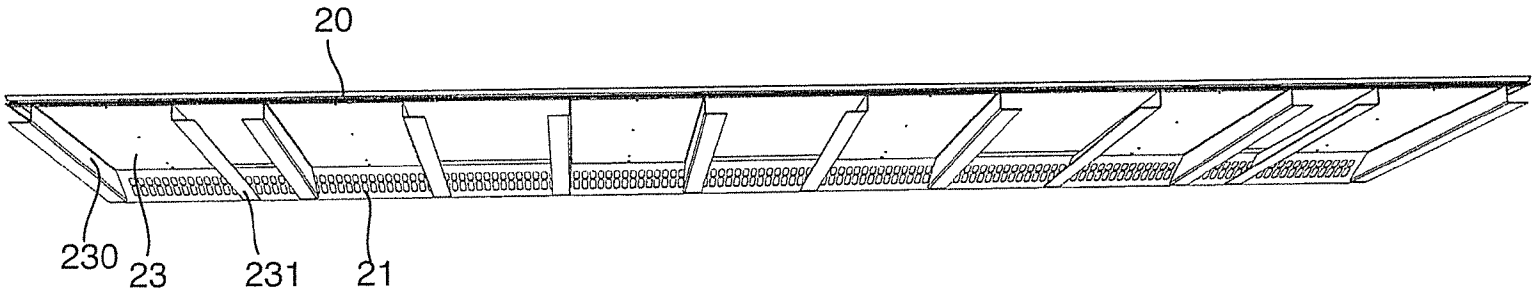
FIG. 3 is a bottom perspective view from below and behind a bottom structure.
Figure 4:
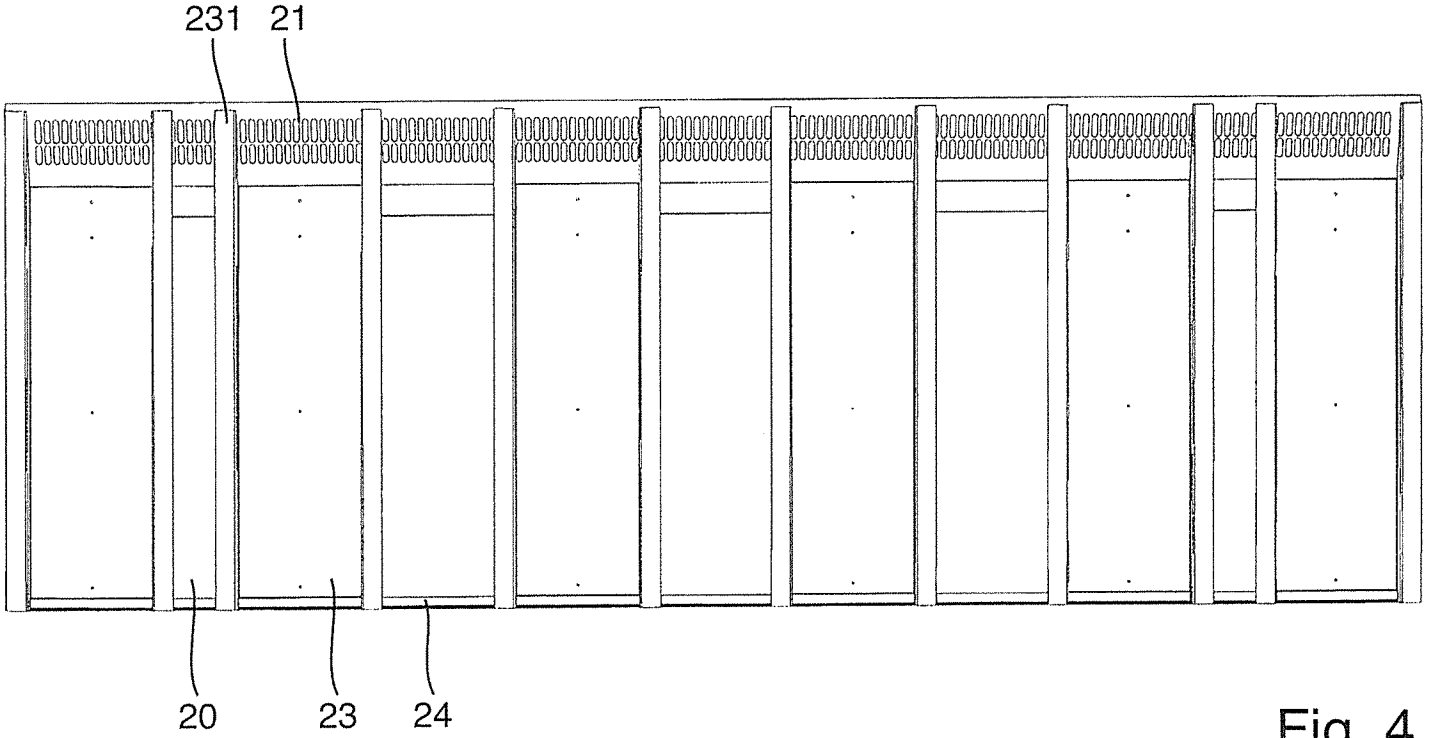
FIG. 4 is a bottom view of the bottom structure according to FIG. 3.

In FIGS. 2-4, bottom structure 2 is shown in greater detail. Bottom structure 2 includes an inner cover 20 oriented toward the cooling chamber, a ramp 21 adjoining it in its front edge region. Bottom structure 2 is equipped with an air passage grille, and a plurality of plate-like support elements 23 situated under inner cover 20, which extend in the depth direction of the container refrigeration case, i.e., from front to back.

In the exemplary embodiment shown in FIGS. 3 and 4, six support elements 23 are arranged under inner cover 20, distributed equidistantly across the width of the case. Support elements 23 each have a plate-shaped support section 232, which rests flat against the underside of inner cover 20 and is mounted to the latter. At its lateral edges extending in the depth direction, support section 232 is provided with support struts 230 that are bent downward at right angles, which in turn have support flanges 231 at their lower ends, which are bent at right angles in the outward direction or alternatively in the inward direction. Support struts 230 and support flange 231 could alternatively be composed of separate Z-shaped profile strips or hollow profiles with a rectangular or square cross-section. But the one-piece design of support elements 23 offers advantages from a production standpoint and also for the support function and the selective guidance (described in greater detail below) of the cooling air. Together with support elements 23, inner cover 20 produces a stable support for one or more rolling containers, which can be conveyed into and out of the cooling chamber via ramp 21.

To this end, bottom structure 2 with the inner cover is embodied as relatively low and ramp 21 is embodied with a relatively slight inclination, with the slope of ramp 21 relative to a horizontal installation floor having an inclination angle in the range of 10° to 25°, preferably between 12° and 20°, e.g., approximately 16°. The distance between inner cover 20 and the installation floor is advantageously in the range between 2 and 6 cm, e.g., between 3 and 5 cm, with the inner cover 20 in a preferred embodiment being inclined toward the rear so that once it has been moved in, a rolling container remains securely in the inserted position. For example, the front edge region of inner cover 20 is spaced 0.5 to 2 cm farther from the installation floor than the rear edge region of inner cover 20. In this instance, support struts 230 are also shaped so that in the depth direction from front to back, they taper in their vertical dimension in accordance with this height difference.

In the exemplary embodiment according to FIG. 4, the front sections of support elements 23 extend to below ramp 21 and are inclined sloping down toward the front in accordance with the inclination angle of ramp 21. Ramp 21 can be attached to inner cover 20 as a separate piece by means of a front, upper flange region and on its underside, can have a flange-like angle bend oriented inward parallel to the installation floor. Alternatively, ramp 21 can be integrally attached to inner cover 20 and can be bent in accordance with the cross-sectional shape of ramp 21.

As shown in FIG. 1, bottom structure 2 extends across the entire width of container refrigeration case 1 and adjoins the lower region of side wall units 5 where it is advantageously fastened in a sealed way. Bottom structure 2 in this case can be composed of one or several pieces in the width direction of container refrigeration case 1. Alternatively, it is also possible for only inner cover 20 to be composed of one piece and, for example, for ramp 21 to be composed of a plurality of pieces in the width direction.

Figure 5C:
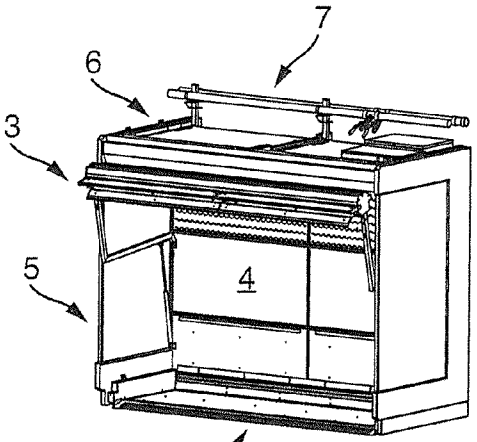
FIGS. 5A, 5B, and 5C illustrate the container refrigeration case according to FIG. 1 in a cross-sectional view with the front panel pivoted downward (FIG. 5A), with the front panel pivoted upward (FIG. 5B), and in a perspective view obliquely from above and in front (FIG. 5C)
Figure 5B:
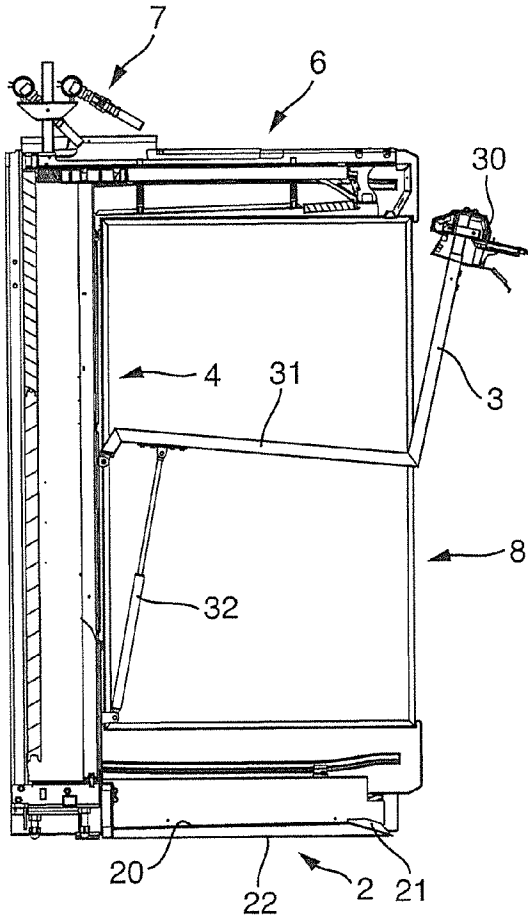
Figure 5A:
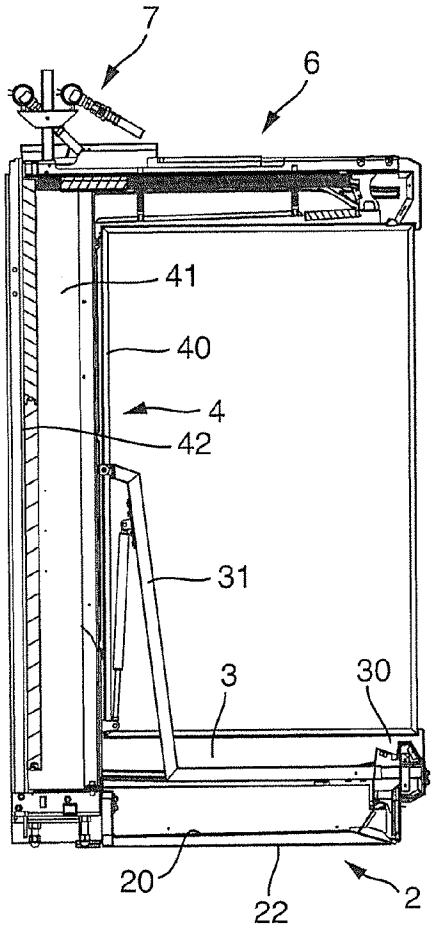

As also shown in FIG. 1 and in particular also in FIGS. 5A, 5B, and 5C, front panel arrangement 3 with front panel 30 has support arms 31 connected at the sides, which when front panel 30 is pivoted downward, have one support arm section that protrudes forward, extending essentially in the horizontal direction and one support arm section that extends upward, inclined slightly toward the rear, which is connected in pivoting fashion by means of a rearward-facing connecting piece via a hinge bearing to the rear lateral region of container refrigeration case 1 (see FIG. 5A). To facilitate pivoting front panel 30 up and down, support arm 31 is secured by means of a piston/cylinder unit that reduces the weight and facilitates the pivoting action (mount 32).

Figure 6B:
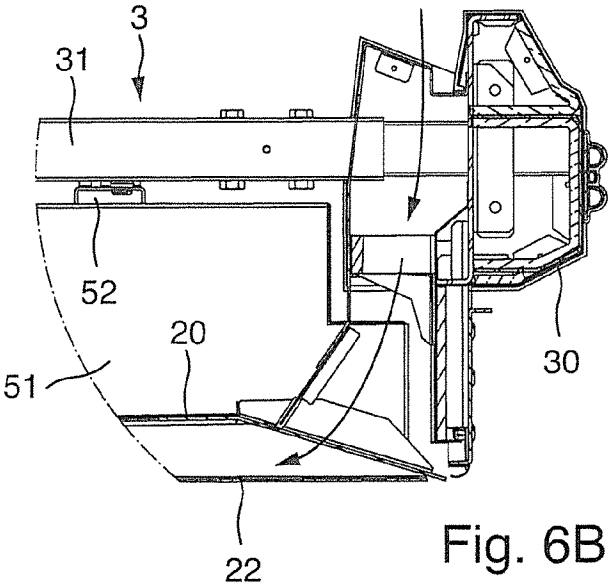
FIGS. 6A and 6B are detailed views of the rear, lower corner region (FIG. 6A) and the front, lower corner region (FIG. 6B) of the container refrigeration case according to FIG. 5A.
Figure 6A:
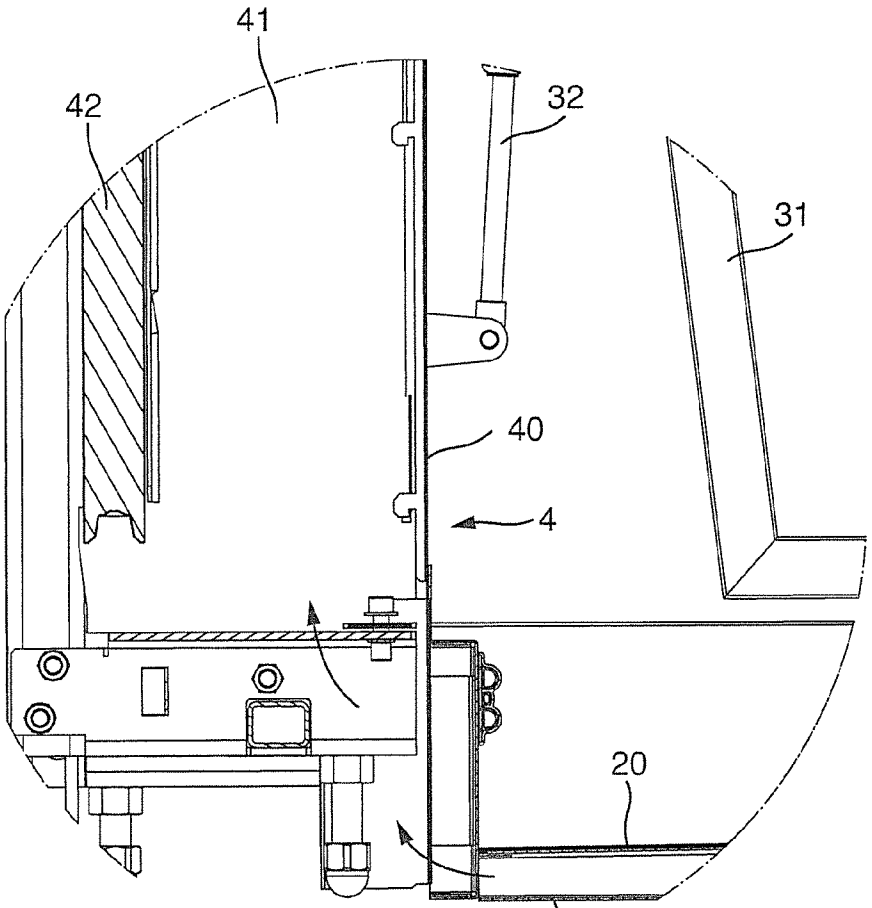

As shown in FIGS. 5A and 5B and also the detail views in FIGS. 6A and 6B, rear wall unit 4 is provided with an inner wall part 40 that borders the cooling chamber toward the rear and, spaced apart from this, a thermally insulating outer wall part 42, with inner wall part 40 and outer wall part 42 forming a vertical rear wall duct 41 between themselves, which extends over the height and width of the rear wall unit (except for a few mounting elements in the lower, upper, and side regions thereof). In its lower region, rear wall duct 41 is connected to the bottom duct section of bottom structure 2, which is embodied under inner cover 20, with the rear wall-side section of bottom structure 2 being connected to the rear wall unit in a sealed way in order to produce a sealed transition between the bottom duct section and rear wall duct 41. The bottom duct section in this case can be covered on its underside oriented toward the installation floor by an outer cover 22, which is advantageously attached to support flanges 231 of support elements 23 and can be composed of a simple piece of sheet metal or of a thermally insulating material such as a foamed plastic material. In its width direction, the bottom duct section preferably extends across the entire width of the case between side wall units 5, with support struts 230 constituting lateral air conduction passages of individual air conduction ducts extending parallel to one another.

In the rear region, side wall units 5 are each provided with a vertical side piece and in their upper and lower regions, are provided with a respective horizontal side piece; a for example plate-shaped side wall element is accommodated between these vertical and horizontal side pieces that are arranged in a C shape. A side beam 51 extending in the depth direction like a pedestal is mounted to the inside of lower horizontal side piece 50 and, with its top surface, forms a shoulder that protrudes inward into the cooling chamber relative to the inside of lower side piece 50, on which shoulder the respective lower support arm section of support arm 31 rests when front panel arrangement 3 is in the pivoted-down position. In the exemplary embodiment shown, a support 52 is attached to the shoulder in order to support arm 31.

In the pivoted-down position, front panel 30, which bulges slightly toward the front, forms an additional air conduction in order to convey a circulating air flow—which extends through rear wall duct 41, through a duct section connected thereto and contained in top unit 6, and through front side 8—into the bottom duct section through the air passage grille of ramp 21 that slopes down toward the front. The air flow in this regard is maintained by means of fans, which are advantageously positioned in rear wall duct 41. The cooling air is produced by cooling unit 7, with a heat exchanger and/or compressor for the air cooling being likewise advantageously accommodated in rear wall duct 41. Also, rear wall duct 41 that extends across the entire width of the case can be divided into a plurality of ducts extending next to one another in the width direction of the case, which can each be equipped with a respective fan for circulating the cooling air.

A wide variety of materials are available for the various parts discussed and illustrated herein. While the principles of this invention have been described in connection with specific embodiments, it should be understood clearly that these descriptions are made only by way of example and are not intended to limit the scope of the invention.

The invention claimed is:

1. A container refrigeration case including (a) at least one cooling air duct extending through a wide area of a rear wall unit and top unit; (b) a bottom region that accommodates a rolling container; and (c) side wall units, wherein cooling air is guided to circulate through the cooling air duct and through a cooling air curtain traveling from top to bottom on a front side, and across the bottom region, characterized in that in order to guide the cooling air, the bottom region is provided with a flat bottom structure situated under the container when the latter is inserted, having an inner cover oriented toward the cooling chamber and a floor-side duct section embodied under this inner cover which routes the cooling air duct from the front side to a lower, rear section of the cooling air duct, the inner cover is supported in the direction of an installation floor by support struts extending from the front to the back in a depth direction, wherein in the operating state, a bottom front panel is provided along and in front of the front side of the bottom structure, the bottom front panel is secured to lateral support arms and can be pivoted upward in order to permit the rolling container to travel in and out, air conduction through the front panel is provided in order to convey a front cooling air curtain into a bottom duct section.

2. The container refrigeration case of claim 1 wherein the inner cover extends across the entire width of the case between two side wall units and in the front edge region of the inner cover, a ramp for a rolling container is attached to it, sloping diagonally down to the installation floor toward the front.

3. The container refrigeration case of claim 2 wherein the ramp and a front region of the inner cover adjacent to it include an air passage grille.

4. The container refrigeration case of claim 2 wherein the rear region of the inner cover is spaced less far apart from the installation floor than its front region and slopes downward from front to back.

5. The container refrigeration case of claim 1 wherein the support struts are embodied in the form of right-angle bends in the plate-shaped support sections, which are attached to the underside of the inner cover.

6. The container refrigeration case of claim 1 wherein along their lower edge, the support struts are provided with support flanges that are bent at right angles.

7. The container refrigeration case of claim 1 wherein on its side oriented toward the installation floor, the bottom structure has an outer cover which is made of either a thermally insulating material or a non-thermally insulating material.

* * * * *